United States Patent [19]

Nelson et al.

[11] Patent Number: 4,817,718

[45] Date of Patent: Apr. 4, 1989

[54] HYDRAULICALLY ACTIVATED FIRING HEAD FOR WELL PERFORATING GUNS

[75] Inventors: John A. Nelson, Spring; Gregg W. Stout, Montgomery, both of Tex.

[73] Assignee: Baker Oil Tools, Inc., Orange, Calif.

[21] Appl. No.: 94,275

[22] Filed: Sep. 8, 1987

[51] Int. Cl.[4] ..... E21B 43/112

[52] U.S. Cl. ..... 166/297; 166/55.1; 175/4.52

[58] Field of Search ..... 166/297, 55, 55.1, 133, 166/142, 149, 151, 188; 175/4.52

[56] References Cited

U.S. PATENT DOCUMENTS

| | | | |
|---|---|---|---|
| 4,341,266 | 7/1982 | Craig | 166/317 |
| 4,515,217 | 5/1985 | Stout | 166/297 |
| 4,526,233 | 7/1985 | Stout | 166/297 X |
| 4,531,590 | 7/1985 | Peterson | 175/4.52 |
| 4,557,331 | 12/1985 | Stout | 166/297 |
| 4,606,409 | 8/1986 | Peterson et al. | 166/297 |
| 4,708,200 | 11/1987 | Salerni et al. | 175/4.52 X |

*Primary Examiner*—William P. Neuder

*Attorney, Agent, or Firm*—Hubbard, Thurman, Turner & Tucker

[57] ABSTRACT

A separable fluid pressure activated firing mechanism for a perforating gun comprises a pressure-operated tubing valve, a packer, and a tubular housing assembly defining a plurality of fluid pressure chambers therein. The first chamber contains a light density, clean, compressible fluid which is subject to well annulus pressure above the packer to provide a reference pressure. A second chamber sealably mounts a piston-type firing pin, which is normally secured by a locked latch in an elevated position above a detonatable primer and the lower portion of said firing pin is exposed to the reference pressure. The latch is unlocked through the application of a predetermined annulus pressure above the packer to a locking piston which moves to unlock the latch and trap the reference pressure in the first chamber. A further increase in said annulus pressure opens the tubing valve. A still further increase in said annulus pressure releases the firing pin from the latch and drives the firing pin downwardly to detonate the primer. Additional features of the disclosure are the provision of a crossover tool between the packer and the tubular housing assembly to permit underbalance perforating, the provision of a detachable connection between the crossover tool and the packer, and the provision of a shiftable sleeve valve effecting the closing of a connection from the packer bore to the annulus upon disconnection of the packer from the cross-over tool.

32 Claims, 9 Drawing Sheets

HYDRAULICALLY ACTIVATED FIRING HEAD FOR WELL PERFORATING GUNS

BACKGROUND OF THE INVENTION

1. Field of the Invention

This invention relates to a hydraulically actuated mechanism for effecting the firing of a well perforating gun, and particularly a firing mechanism which is responsive only to two successive increases in the well annulus pressure above a set packer to two predetermined values.

2. Summary of the Prior Art

The perforating of well casings and the adjoining production formation by the detonation of a plurality of explosive-shaped charges is the predominate method employed to initiate production flow from a producing formation traversed by the well casing. As is well known in the art, it is highly desirable that the well be perforated in a so-called "underbalanced" condition; i.e., the pressure in the annulus between the perforating gun and the bore of the well casing is maintained at a substantially lower value prior to firing the perforating gun than the formation pressure, thus contributing to an immediate flow of production fluid from the perforated formation. Such underbalanced condition is generally obtained by the setting of a packer above a tubing-carried perforating gun to position the perforating gun adjacent to the production formation. Thus, the casing annulus above the packer is isolated from the casing annulus below the packer. One or more axially extending fluid passages are provided in the body of the packer which communicate between the casing annulus above the packer and an inlet passage of a crossover tool located below the packer. Such cross-over tool transmits the casing annulus fluid pressure to the interior of the firing mechanism for the perforating gun, while connecting the tubing bore to the casing annulus below the packer through radial ports. With this arrangement, a pressure differential can be readily obtained between the casing annulus pressure above the packer and the tubing pressure, and such differential has been employed to effect the actuation of the firing mechanism for the perforating gun.

Those skilled in the art will further recognize that in the initial drilling of the well, it is highly desirable to test the various production formations traversed by the well. Such testing has to inherently involve the perforating of at least a portion of the production formation, and it has been common to effect such perforation by a wireline-carried perforating gun and to control the well by drilling mud. This method is highly unsatisfactory for the reason that the drilling mud effects a contamination of the newly formed well perforations and reduces the productive capability of the particular perforations. Additionally, the opportunity to perforate in an underbalanced condition and to get a true measure of the fluid pressure of the perforated production formation does not exist.

Accordingly, prior art attempts to obtain underbalanced perforation in the so-called drill stem testing operations have involved the use of a tubing-mounted perforating gun and a packer which is inserted in the newly cased well on the bottom of the drill pipe or drill stem. Included in this hookup is a ball valve which is normally closed as the drill stem, packer, cross-over tool, and perforating gun are run into the well, thus maintaining a lower pressure in the interior of the test string. Such ball valve must, of course, be opened to establish an underbalanced condition in the well annulus adjacent the perforating gun and to accommodate the flow of fluid from the formation being tested upwardly in the drill stem, at least to the point where pressure recorders and other instruments are mounted, in order to evaluate the productivity of the particular area of the well being perforated.

Such ball valves are normally opened by applying an increased pressure to the fluid existing in the well annulus above the packer or, in other words, by establishing a differential between the well annulus pressure and a hydrostatic reference pressure trapped in the ball valve. This pressure differential therefore cannot be utilized to effect the activation of a conventional fluid pressure operated firing mechanism for the perforating gun because the gun could fire prematurely before the ball valve is completely opened. It therefore becomes not only desirable, but highly necessary that a pressure-activated firing mechanism for a perforating gun employed in underbalanced drill stem testing be capable of responding only to an annulus fluid pressure other than the differential between the casing annulus pressure and the pressure within the drill pipe or drill stem; and other than the annulus pressure at which the ball valve is operated.

The prior art has also resorted to utilization of a trapped fluid pressure disposed within a tubular housing assemblage surrounding a piston-type firing hammer or firing pin. The required firing movement of the hammer or firing pin was then derived by achieving a predetermined differential between the annulus fluid pressure above the packer and the trapped fluid pressure. Unfortunately, when the fluid pressure operated test valve was opened and the pressure in the annulus surrounding the firing mechanism was reduced to achieve underbalancing, such reduction produced a substantial pressure differential across the walls of the chambers enclosing the trapped fluid and such chamber inherently expanded sufficiently to significantly reduce the fluid pressure of the trapped fluid so that premature firing was again a distinct possibility.

It is therefore highly desirable that a firing mechanism be provided which is responsive to the readily controlled annulus fluid pressure existing above the packer but which will not effect the firing of the perforating gun upon an increase in annulus fluid pressure above the packer to a level sufficient to open the pressure-operated test valve.

It is also desirable to be able to remove the packer from the firing mechanism in the event the firing mechanism or the perforating gun becomes lodged in the well. Thus, a detachable connection between the packer and the firing mechanism is another desirable attribute of such apparatus.

SUMMARY OF THE INVENTION

The invention provides a fluid pressure activated firing mechanism for a perforating gun which is activated by successive predetermined increases in the casing annulus pressure above the set packer. Normally, when the invention is employed in conjunction with drill stem testing, the first predetermined increase in the casing annulus pressure establishes a hydrostatic reference pressure in the firing mechanism substantially equal to the reference pressure incorporated in a conventional annulus pressure responsive ball valve employed in the drill stem testing apparatus. A further substantial increase in casing annulus pressure is then required to open the ball valve. A second substantial increase in well annulus pressure to exceed the ball valve-opening level is required to effect the activation of the firing mechanism embodying this invention, thus insuring that the perforating gun is not prematurely or accidentally discharged by the pressure differential between the casing annulus pressure and the pressure existing within the drill pipe, or by the annulus pressure required to open the ball valve. The activation of the firing mechanism is completely independent of drill stem pressure or hydrostatic pressure existing in the well.

The firing mechanism embodying this invention comprises a tubular housing assembly which is in communication with the top end of a conventional perforating gun, and preferably the bore of the tubular housing is in communication with a detonatable primer located in the top end of such perforating gun. Above the housing assembly, a cross-over tool is secured between the housing and a conventional packer. Above the packer is mounted a conventional pressure-operated, ball-type test valve and pressure and flow recorders; and the entire assemblage is supported by a drill stem or other tubular string. The ball valve is usually closed during run-in but can be opened by a preselected increase in annulus pressure above well hydrostatic pressure after the packer is set. The applied annulus pressure provides an automatic test of the packer seal, because, with the ball valve open, packer leakage will return to the surface through the drill stem.

The tubular housing assembly provides a central bore surrounded by two axially elongated, concentric annular fluid pressure chambers. An elongated piston-type firing pin is sealably mounted in the central bore of the tubular housing assembly and held in an elevated position relative to the detonatable primer by a mechanical latch, which is releasable by the exertion of a predetermined amount of downward force on the piston-type firing pin. Axially spaced external seals provided on the piston-type firing pin cooperate with the bore of the tubular housing assembly to define a third annular atmospheric pressure chamber in the tubular housing assembly with the result that there is a relatively large, axially extending, annular atmospheric pressure force-intensifier chamber. The force-intensifier chamber is maintained at atmospheric pressure during the run-in of the apparatus and until the firing pin moves downwardly to impact against the detonator which unloads the reference pressure into the atmospheric chamber. The reference fluid pressure chamber is filled at the well surface with a clean, light density, compressible fluid, such as silicone oil, and the upper end of the reference fluid chamber communicates with the hydrostatic well pressure below the packer both before and after the packer is set. This communication occurs through a port and a water leg in the body of the firing head.

Above the piston-type firing pin, a fourth fluid pressure chamber is provided which is connected by suitable conduit, including an axially extending passage through the body of the packer, to a port located above the packer seals and communicating with the well annulus above the packer. A multipurpose piston is disposed in the fourth fluid pressure chamber and is spring-biased to, and shear-pinned in its run-in position. In the run-in position, the piston locks the mechanical latching mechanism in its retaining position relative to the firing pin, thus eliminating the possibility of premature release of the firing pin during the run-in procedures.

Seal elements are also provided on such locking pistons which cooperate with a port defined in the conduit extending from the top of the reference fluid pressure chamber to the water leg. In the run-in position of the piston, this port is open, but as the fluid pressure in the well annulus above the set packer is increased to a first predetermined level, the piston is moved upwardly by such predetermined increase in annulus pressure above the packer to a position closing the port, thus trapping the fluid in the reference fluid pressure chamber at whatever hydrostatic pressure it was under at the time the well annulus pressure above the packer was increased. This will be substantially the same hydrostatic reference pressure as is employed in the pressure-operated ball valve. Concurrently, the piston moves upwardly out of its locking relationship with the mechanical latch, thus freeing such latch to release whenever the annulus fluid pressure acting on the top end of the piston-type firing pin is increased to a second predetermined value sufficient to effect the release of the firing pin from the mechanical latch. The piston is then driven downwardly by the said annulus fluid pressure to detonate the primer.

As the piston-type firing pin approaches the detonating primer, the lowermost external sealing means carried by the piston passes over a port communicating with the reference fluid pressure chamber and hence the fluid pressure in the reference fluid pressure chamber is permitted to dissipate into the atmospheric chamber defined on the exterior of the piston-type firing pin to provide an increased pressure differential on the piston-type firing pin. The annulus fluid pressure above the packer required to effect the aforedescribed upward movement of the multipurpose piston is preferably selected to substantially exceed the annulus fluid pressure required to effect the opening of the pressure-operated ball valve. It is therefore assured that the fluid passage through the tubing string is completely open and in communication with the annulus surrounding the perforating gun so that perforating under underbalanced conditions can be readily achieved by conventional procedures.

The hydrostatic reference fluid pressure contained in the reference fluid pressure chamber is applied to the bottom portions of the piston-type firing pin to oppose its downward movement. This pressure remains substantially constant despite the exposure of the exterior of the tubular housing assembly to the reduced fluid pressure existing in the tubing bore by the opening of the pressure-operated ball valve. Because the reference fluid pressure chamber is surrounded on both of its major wall portions by atmospheric pressure, no mechanical stresses are imposed on that portion of the tubular housing assembly defining the reference fluid pressure chamber so as to expand the chamber and cause a sharp drop in the reference fluid pressure. It is therefore assured that firing of the perforating gun will occur only upon increase of the annulus fluid pressure above the packer to a second predetermined level above the level at which the multipurpose piston is shifted to release the latching mechanism and trap the reference fluid pressure in the reference fluid pressure chamber.

A number of significant safety and utilitarian features have been built into the firing mechanism embodying this invention. For example, if the perforating gun does not fire, the downward movement of the piston-type firing pin effects a bleed off of the trapped fluid pressure contained in the reference fluid pressure chamber. The reduction of annulus fluid pressure above the packer from the surface immediately removes any fluid pressure tending to urge the firing pin downwardly so that the apparatus can be conveniently and safely removed from the well.

In other situations, the perforating gun may have fired, but when an attempt is made to pull the perforating gun from the well, the gun may get jammed. In this situation, the gun is released by actuation of a pressure releasable connection between the cross-over tool and the packer. By dropping a ball or plug on an upwardly facing seating surface provided on a sleeve shearably secured in the bore of the cross-over tool, the tubing pressure may be increased sufficiently to shift the sleeve downwardly and thus free locking keys to move radially inwardly and release the packer from its connection to the cross-over tool, thus permitting the packer and all tools above the packer to be removed from the well.

In accordance with a further embodiment of this invention, the cross-over tool has a thin-walled sleeve or snorkel tube extending upwardly within the bore of the packer to the casing annulus above the packer. Upon removal of the packer from the cross-over tool, the snorkel tube is removed from engagement with still another sleeve piston which is biased downwardly by tubing pressure established within the drill pipe. This movement of the upper sleeve piston brings a pair of seals into straddling relationship with the port providing communication between the axially extending annulus passage through the packer and the casing annulus above the packer, thus sealing off such passage. An expandable spring lock secures the upper sleeve piston in its passage-closing position so that the packer can be reset and wireline perforating guns lowered through the bore of the drill stem and the packer to effect any additional perforation tests without incurring any danger of the resulting fluid flowing up through the tubing and into the casing annulus.

Other advantages of the invention will be readily apparent to those skilled in the art from the following detailed description, taken in conjunction with the annexed sheets of drawings, on which is shown a preferred embodiment of the invention.

DESCRIPTION OF PREFERRED EMBODIMENTS

Figure 1:
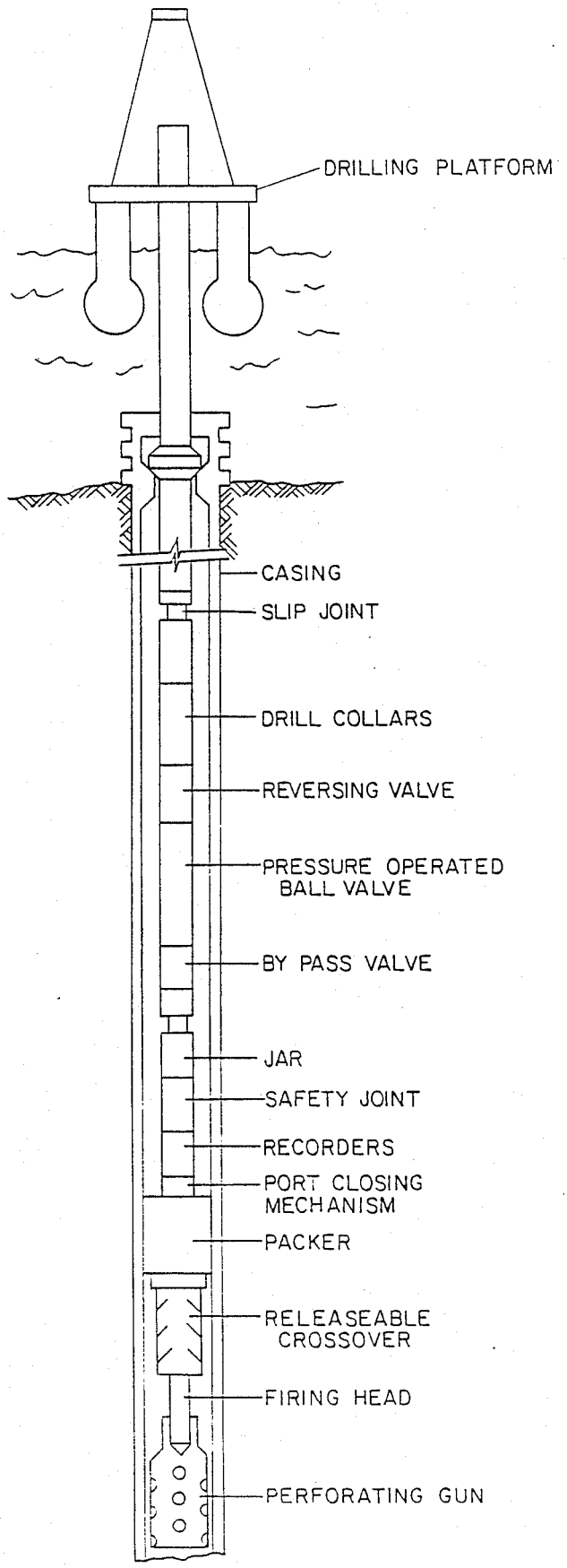
FIG. 1 is a schematic elevational view of a drill stem testing assemblage incorporating the releasable, fluid pressure activated firing mechanism embodying this invention.
Figure 2A:
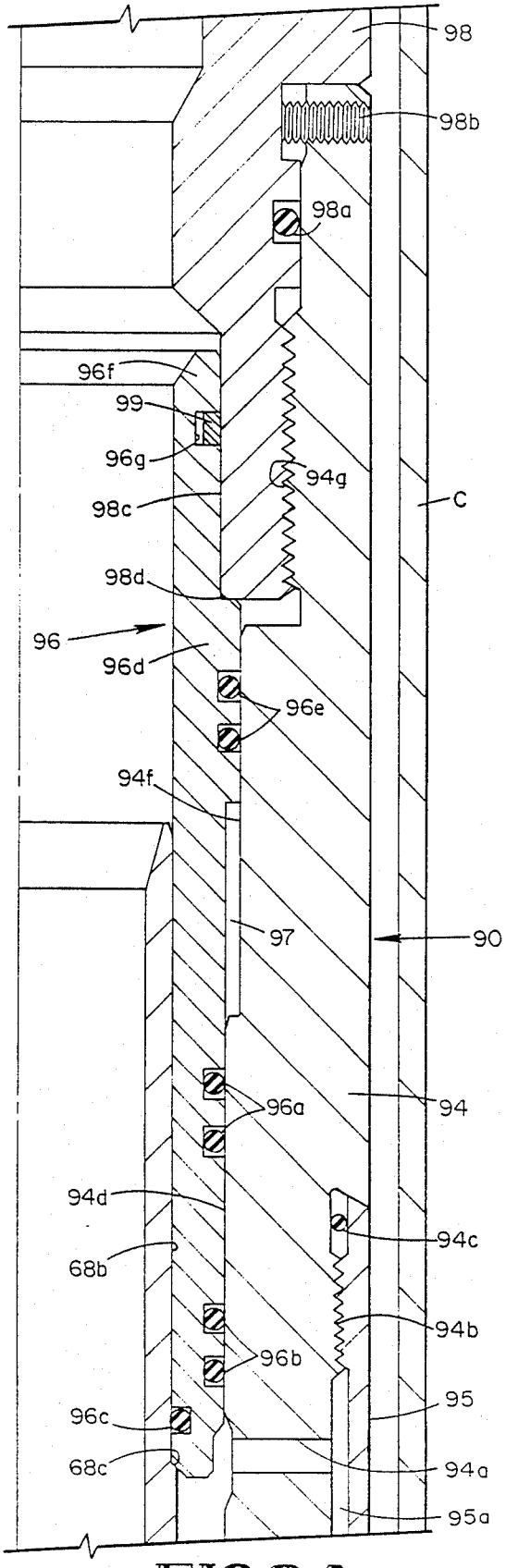
FIGS. 2A–2H are enlarged scale, vertical sectional views collectively representing all of the elements of a drill stem testing string embodying this invention, with all elements shown in their run-in positions.

While not limited thereto, a releasable firing mechanism embodying this invention will be described in conjunction with its application to drill stem testing of a partially completed well. Thus, the well has been drilled to a depth wherein it has traversed one or more production formations, casing has been set in place, and it is desired to test a formation traversed by the well before proceeding with further drilling. Referring then to FIG. 1, there is schematically illustrated a tool string which is assembled on a drill stem or drill tubing string to effect sufficient perforations in a production zone to achieve the necessary testing of the productive capabilities of such zone.

Starting at the bottom, there is a conventional perforating gun (FIG. 1) which incorporates a plurality of peripherally spaced perforating charges. The gun is suspended from a fluid pressure activated firing head embodying this invention. The firing mechanism is in turn suspended from a releasable cross-over tool embodying this invention. At the top end of the cross-over tool, a pressure-responsive latching mechanism is provided for detachably connecting the cross-over tool to the bottom end of the hollow body portion of a conventional packer. At the upper end of the packer there is provided an annulus port-closing mechanism embodying this invention which functions only when the packer is disconnected from the cross-over tool by the pressure-responsive release mechanism. Above the annulus port-closing mechanism, there is provided other conventional tools required for drill stem testing of the well. For example, instrumentation in the form of pressure recorders and/or flow meters may be provided and above or below such instrumentation, a safety joint, jars, and a bypass valve may also be provided. A conventional pressure-operated ball valve is mounted in the tool string which is normally closed, but is operable to an open position by increasing the annulus pressure to a predetermined level above a hydrostatic reference pressure. Such ball valve may comprise the pressure-operated test tool described in U.S. Pat. No. 4,431,266. Since all of the mechanism and instrumentation located above the port-closing mechanism comprise conventional tools commonly employed in drill stem testing, further description of such mechanisms and instrumentation is believed to be unnecessary.

Referring now to FIGS. 2A–2H, which collectively show the details of the releasable firing mechanism embodying this invention, there is shown the top end of a conventional perforating gun 1 mounted within a well casing C. Gun 1 incorporates a plurality of peripherally and vertically spaced, shaped charges (not shown) which are ignitable by a central primer cord PC extending upwardly through bore 1*a* to a booster charge BC which is disposed below a detonatable primer P mounted in a counter bore 11*a* formed in the upper end of a primer mounting sleeve 11. Primer mounting sleeve 11 forms part of a tubular housing assembly 10 within which the entire firing mechanism embodying this invention is incorporated.

The tubular housing assembly 10 comprises a lower body sleeve portion 12 having internal threads 12*a* engaging external threads 1*b* provided on the top end of the perforating gun 1. O-ring seals 1*c* seal this threaded connection.

The top end of the lower body sleeve 12 is provided with internal threads 12*b* which threadably engage external threads 14*a* provided on an outer annular wall 14 of an annular fluid pressure chamber 15. O-rings 14*b* seal the threads 14*a*.

The lower end of outer annular wall 14 is provided with internal threads 14*c* which threadably engage external threads 16*a* provided on the bottom end of an inner annular wall element 16. O-rings 16*b* seal threads 16a. An annular reference fluid pressure chamber 15 is thus defined between inner annular wall 16 and outer annular wall 14 which is filled with a clean, light density, compressible fluid such as silicone oil. The lower end of inner annular wall 16 is further provided with internal threads 16c which threadably engage the external threads 11b provided on the upper end of the primer support sleeve 11. O-rings 11c seal this threaded connection. The top end of inner annular wall 16 mounts O-rings 16g which sealably engage an inner surface 14n of outer annular outer wall 14.

A guide tube 18 is threadably secured to the internal wall of primer support sleeve 11 by threads 18a, which are sealed by an O-ring 18b. Guide tube 18 defines a cylindrical bore 18c within which is slidably mounted the lower end portion 42 of the piston-type firing pin 40. The lower end portion 42 is provided with a bottom pointed end 42a for effecting the detonation of primer P and with a plurality spaced, axially extending guide ribs 42b which contact the central bore surface 18c of the guide tube 18 but permit free passage of fluid along the length of the lower end portion 42. An O-ring 18d effects a sealing engagement between the bottom surface of guide tube 18 and the top surface of the detonatable primer P.

The top of lower end portion 42 of piston-type firing pin 40 is externally threaded as shown at 42c and is secured to an axially elongated piston portion 44. Piston portion 44 has two axially spaced sets of internal seals 44a and 44b which respectively engage a seal bore 16d defined in an internally projecting portion 16e of the annular inner wall element 16, and thus define an annular chamber 17 adjacent the inner wall element 16. A radial port 16k connects chamber 15 with the space surrounding lower portion 42 of firing pin 40.

The extreme upper end of the piston portion 44 is provided with an enlarged head portion 44c which is engaged by the heads 54a of a latching collet 52 to secure the piston-type firing element 40 in an elevated position with respect to the primer P, as will be hereinafter described in more detail.

Adjacent the upper end of the reference fluid pressure chamber 15, the lower body sleeve 14 of the tubular housing assembly 10 is provided with a radial port 14d which is plugged at its outer end by a conventional sealing plug 13. Radial port 14d in turn communicates with an axially extending passage 14e which ends in an inwardly directed radial port 14f. Obviously, more than one set of passages 14d, 14e and 14f may be provided in the lower tubular body 14 in peripherally spaced relationship to each other.

Immediately below the inwardly directed radial ports 14f, the lower tubular body element 14 defines an internal cylindrical bore surface 14g. The cylindrical surface 14g is sealably engaged by an axially depending sleeve portion 20a formed on the bottom of an upper tubular body element 20. O-rings 20b effect the sealing engagement of sleeve portion 20a with the cylindrical bore surface 14g. Above the cylindrical sleeve portion 20a, the upper tubular body portion 20 is provided with external threads 20c which cooperate with internal threads formed on the upper end of the lower tubular body portion 14. Threads 20c are sealed by an O-ring 20d and a plurality of peripherally spaced set screws 20f secures the threaded connection.

The upper tubular body portion 20 is provided with a plurality of peripherally spaced radial ports 20j respectively communicating with the inwardly directed radial ports 14f. Ports 20j in turn communicate with an axially elongated annular fluid passage 21 defined between the exterior wall 30a of an axially elongated tubular piston 30 and the internal surface 20p of upper tubular body portion 20. Piston 30 is provided with a pair of axially spaced external O-rings 30b and 30c and the lowermost O-ring 30b is in sealing engagement with the internal surface of the sleeve portion 20a. The upper O-ring 30c is disposed to move into sealing engagement with an internal surface 20g formed on the upper tubular body portion 20 when the piston 30 is moved upwardly, in a manner to be hereinafter described. The upper portion of piston 30 is of increased thickness and mounts a pair of O-ring seals 30d which are in sealing engagement with an internal bore surface 20h formed on the upper tubular body portion 20.

The top end of the lower body sleeve portion 14 is of reduced thickness and cooperates with the lower end of the upper tubular body portion 20 to define a downwardly directed water leg passage 23. The top end of annular fluid passage 21 is connected to the water leg passage 23 by a plurality of peripherally spaced radial ports 20e formed in the upper tubular body portion 20. A pressure-transmitting, wiper-type seal 25 is mounted in the water leg passage 23 and the lower end of such passage is placed in communication with the well annulus by a plurality of peripherally spaced radial ports 14h. An O-ring 20n prevents leakage of fluid into or out of the top of water leg passage 23. Thus, when the reference fluid pressure chamber 15 and the various passages connecting therewith, such as radial ports 14d, axial passages 14e, radial ports 14f and 20j, annular passage 21, radial ports 20e, water leg 23 and radial ports 14h, are filled with a light density, compressible fluid, such as silicone oil, the entire fluid is subjected to the well hydrostatic pressure as the apparatus is lowered into position in the well.

Figure 2E:
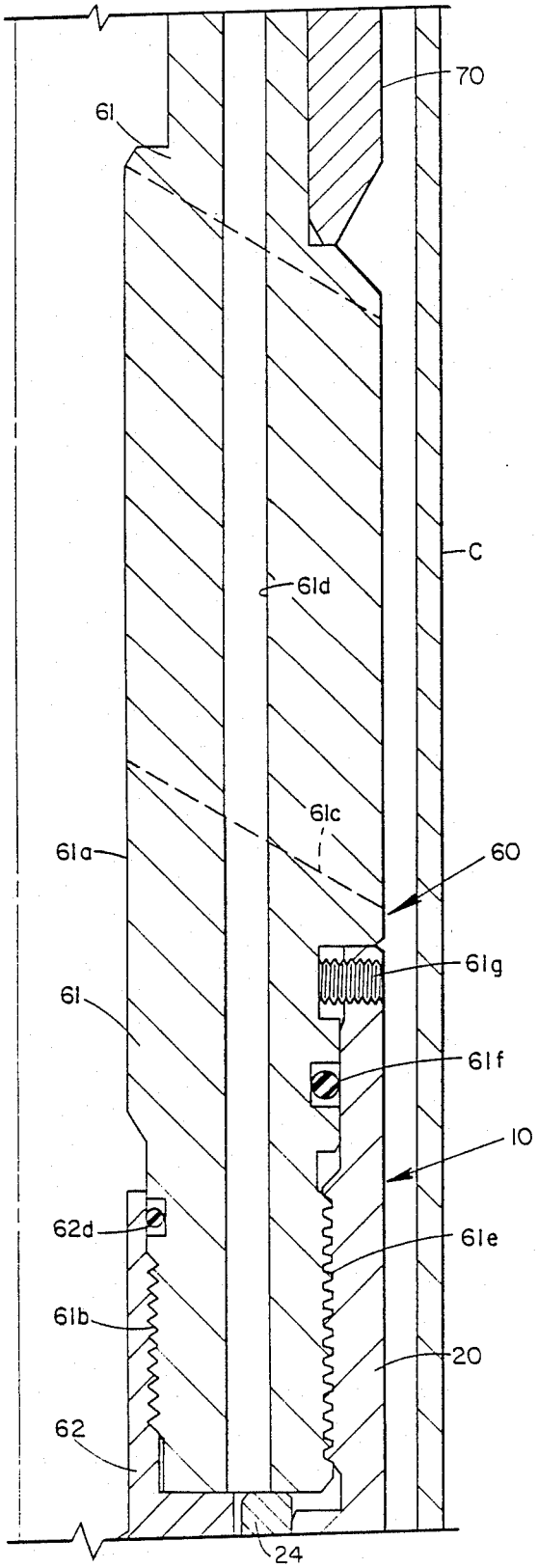
Figure 3E:
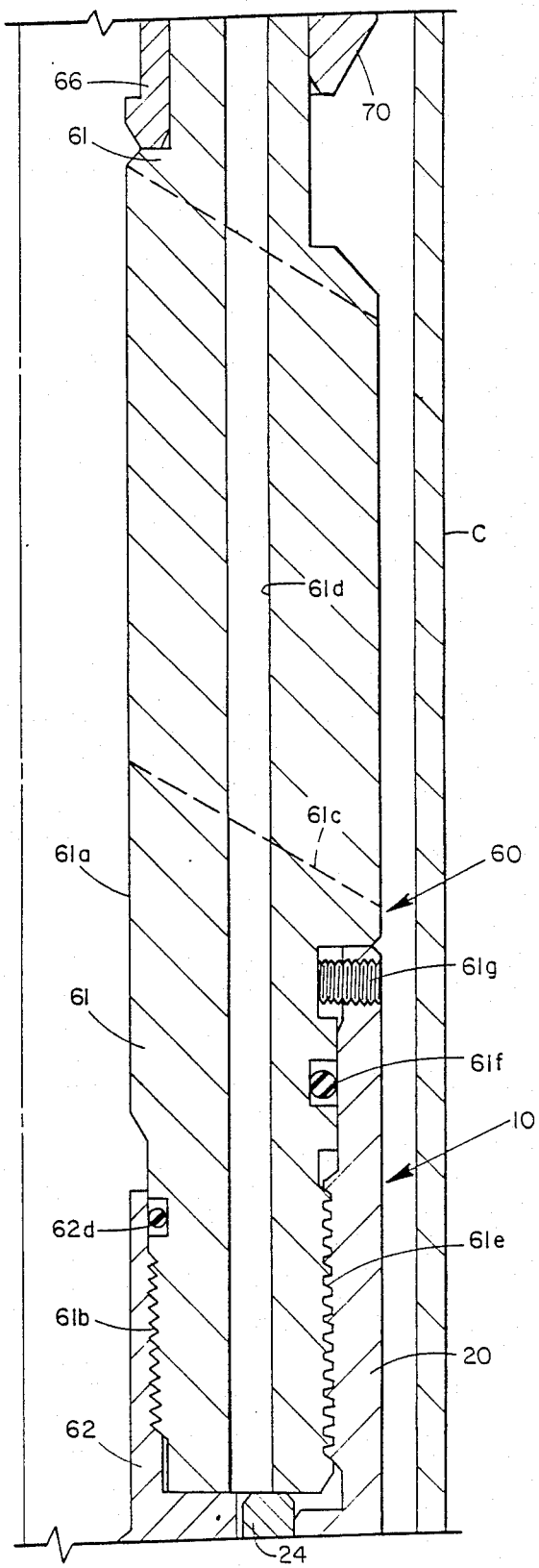
Figure 2F:
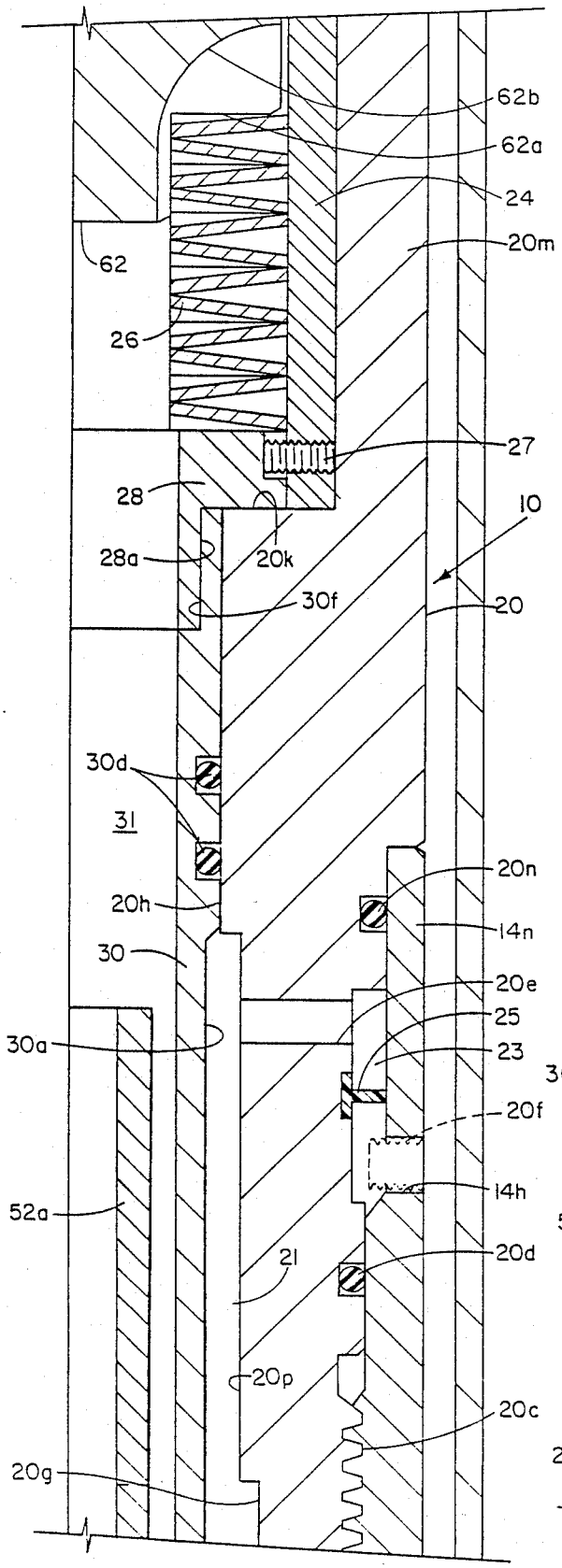
Figure 3F:
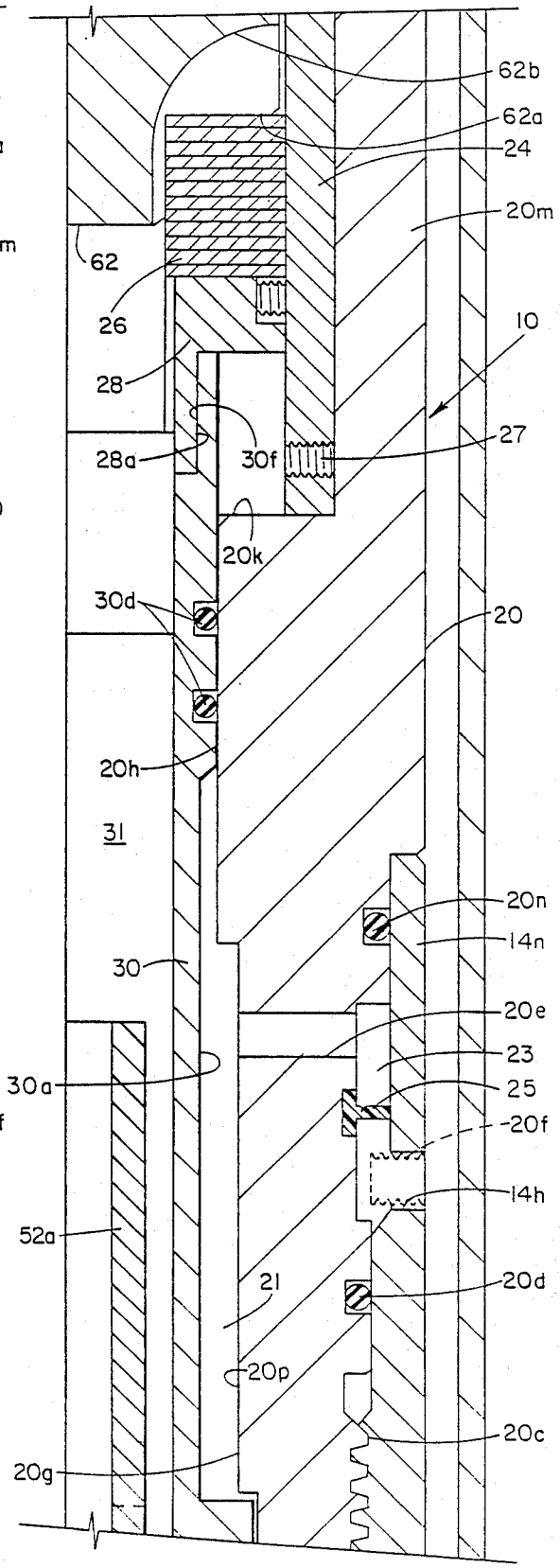

The uppermost portion 20m of upper tubular body portion 20 is of reduced thickness, thus defining an upwardly facing shoulder 20k. A spring guide sleeve 24 surrounds the upper reduced-thickness portion 20m of the intermediate tubular body portion 20 and is trapped between the upwardly facing shoulder 20k and the bottom end of a cross-over tool 60 (FIG. 2E). A suitable compression spring 26, here shown as an axial stack of Bellville spring elements rests on a spring support sleeve 28 which in turn has a reduced-thickness, axially depending portion 28a telescopically engaged with the top end 30f of the piston 30. A plurality of peripherally spaced shear bolts 27 are attached between the spring support ring 28 and the spring guide sleeve 24 so that upward movement of the piston 30 to compress the spring 26 cannot occur until sufficient upward force is applied to effect the shearing of the shear bolts 27.

The extreme top end of the upper body portion 20 of the tubular housing assemblage 10 is provided with internal threads which cooperate with external threads 61e provided on the bottom end of the cross-over tool 60. The threads 61e are sealed by an O-ring 61f and the threaded connection is secured by a set screw 61g.

Cross-over tool 60 has the conventional, generally cylindrical, tubular body 61 which defines a central bore 61a which is in communication with the packer bore 80b (FIG. 2C) and hence communicates with the bore of the tubing string on which the packer is supported. Such central bore passage 61a is closed at the bottom end of the cross-over tool by a plug 62 which is threadably engaged in internal threads 61b provided in the lower end of the cross-over tool body 61. Threads 61*b* are sealed by O-ring 62*d*. The bottom of plug 62 is machined to provide downwardly facing spring seat shoulders 62*a* which are traversed by peripherally spaced slots 62*b*.

A plurality of radially and downwardly directed ports 61*c* are also defined in cross-over tool body 61, preferably spaced at 120-degree intervals providing communication between the central bore 61*a* and the casing annulus surrounding the cross-over tool. Intermediate the radial passages 61*c*, the cross-over tool body 61 is provided with a plurality of peripherally spaced, axially extending fluid passages 61*d* which extend entirely through the axial length of the cross-over tool body 61. At the lower end, the axially extending passages 61*d* communicate with the slots 62*b* and hence with the central chamber 31 within which piston 30 and piston-type firing pin 40 are mounted and thus pressured fluid introduced into such passages from the well annulus above the set packer 80 is caused to act upon the enlarged bottom end surface 30*k* of the piston 30 and also upon the top surface 44*c* of the piston portion 44 of the piston-type firing pin 40. Thus, a downwardly directed force is exerted on the piston-type firing pin 40 and an upwardly directed force is applied to the piston 30.

It was previously mentioned that the piston-type firing pin 40 is secured in an elevated position relative to the detonatable primer P by locking heads 54*a* of a collet 52. Collet 52 is of the well-known type having two solid ring end portions 52*a* and 52*b* respectively located at its opposite axial ends, and resilient, radially deflectable arm portions 54 disposed intermediate the solid ring portions 52*a* and 52*b* and terminating at their lower ends with inwardly projecting head portions 54*a*. The lower ring portion 52*b* of collet 52 is provided with external threads 52*c* and engages with cooperating threads provided on the top end of the inner wall 16. Collet head portions 54*a* respectively engage a downwardly facing annular shoulder 44*d* provided immediately below the top end surface 44*c* of the piston portion 44 of the piston-type firing pin 40.

Figure 3A:
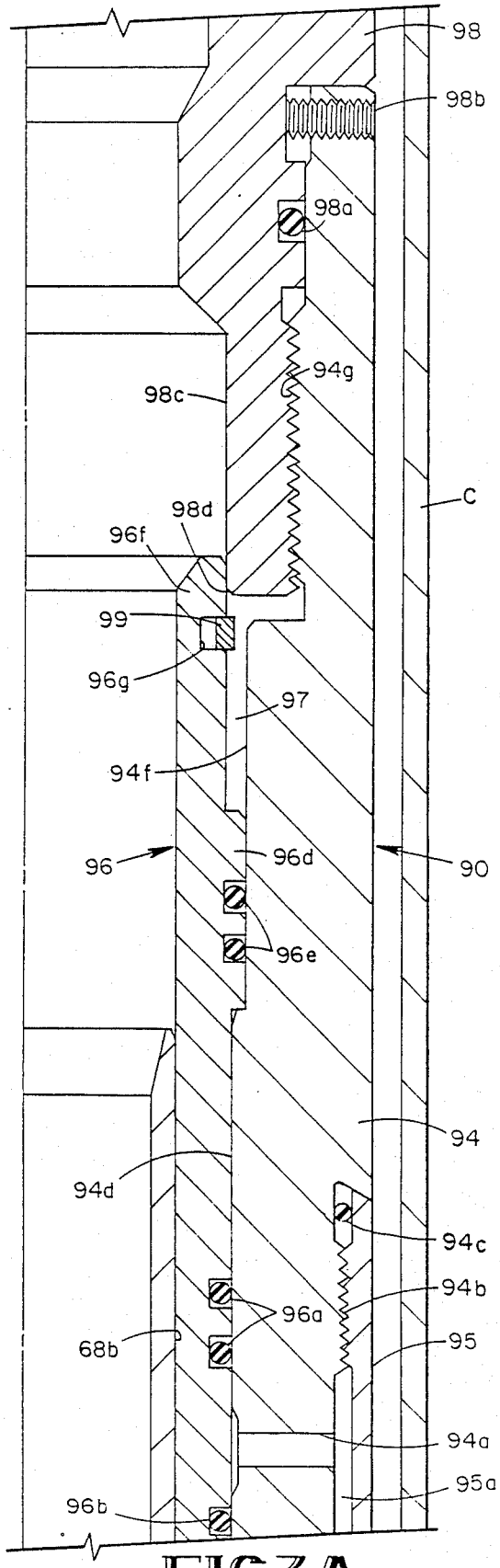
FIGS. 3A–3H are views similar respectively to FIGS. 2A–2H but showing the various elements in the position assumed after firing of the perforating gun and during removal of the packer and upper portions of the drill stem testing string.
Figure 2B:
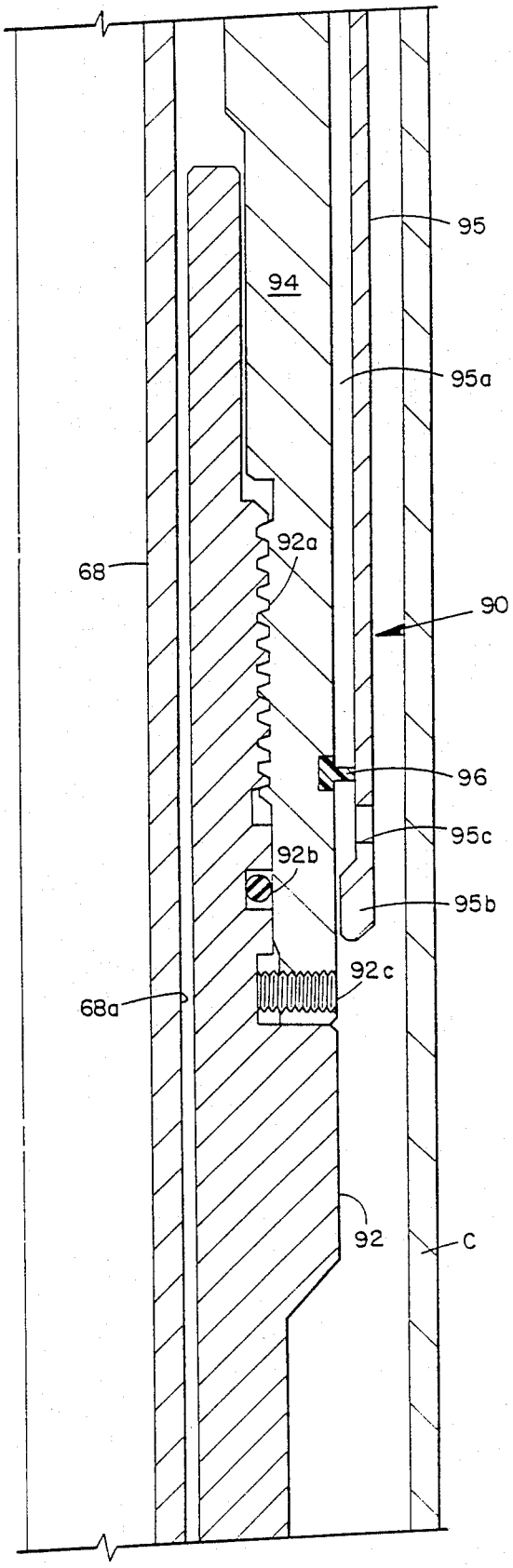
Figure 3B:
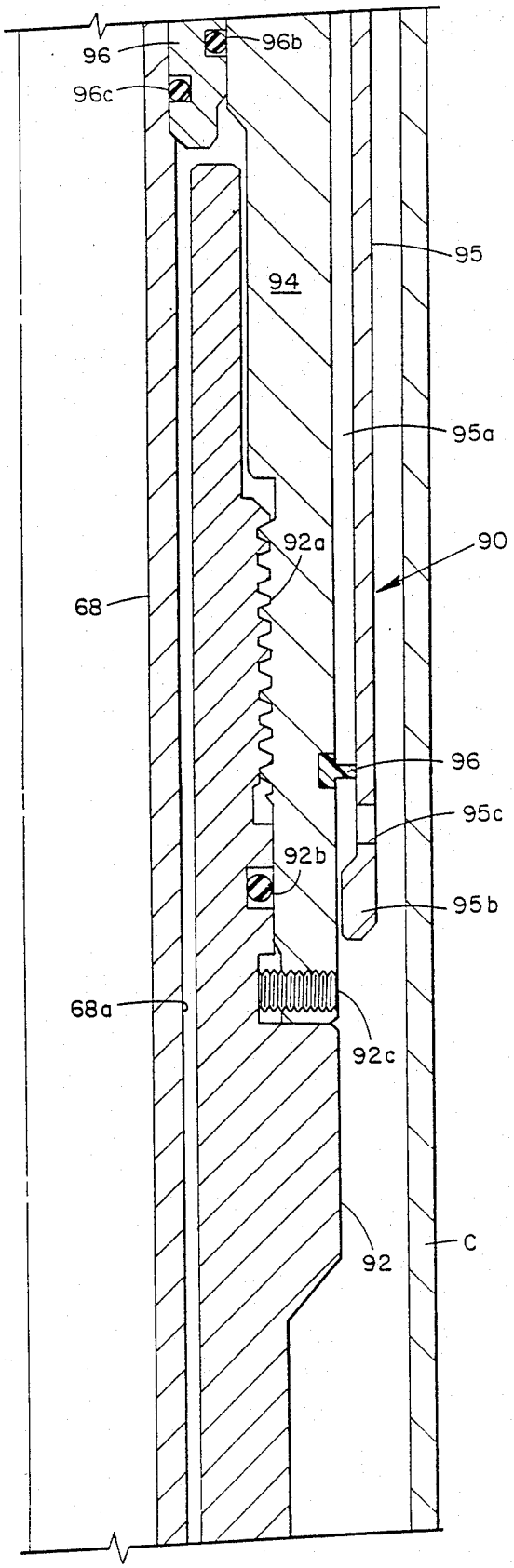
Figure 2C:
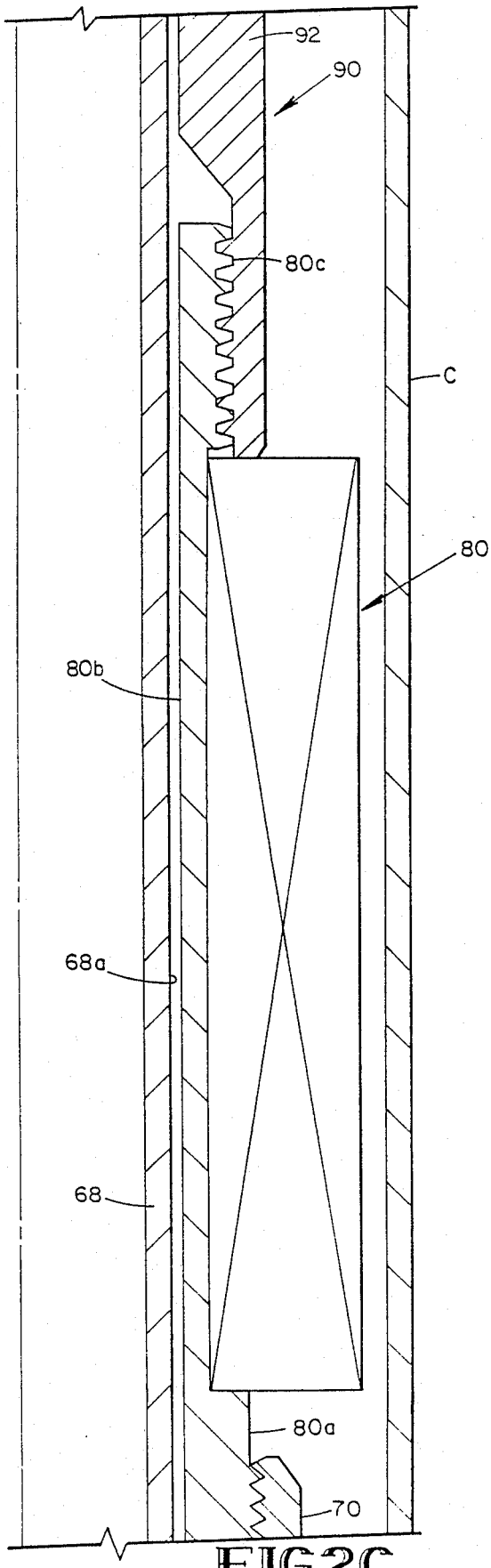
Figure 3C:
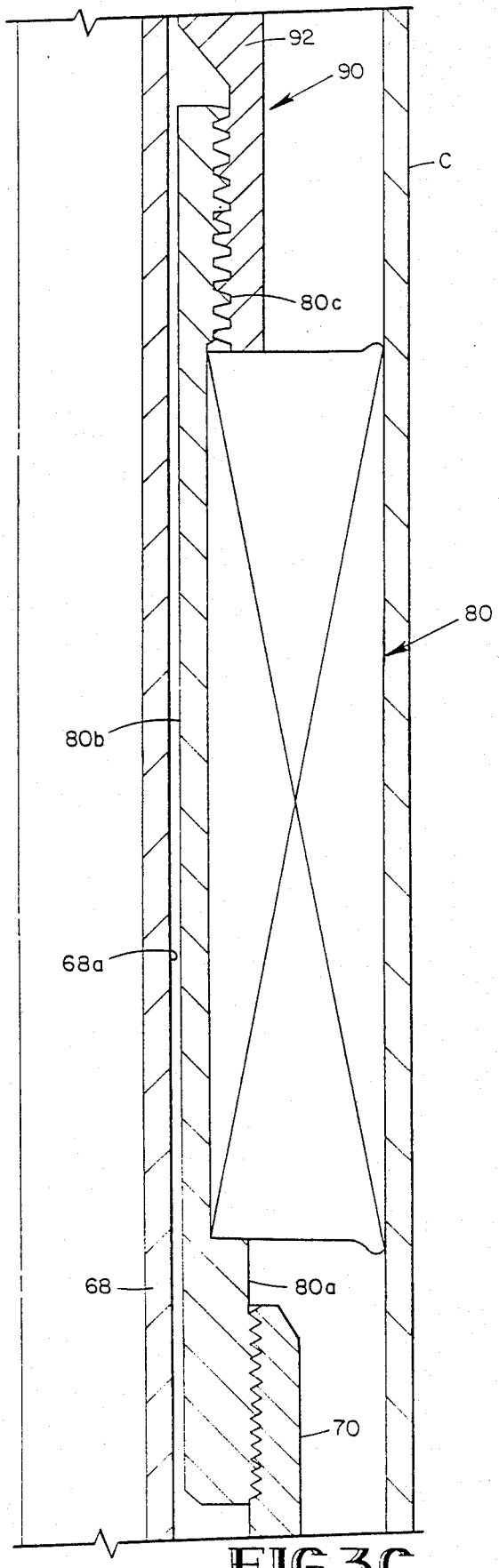
Figure 2D:
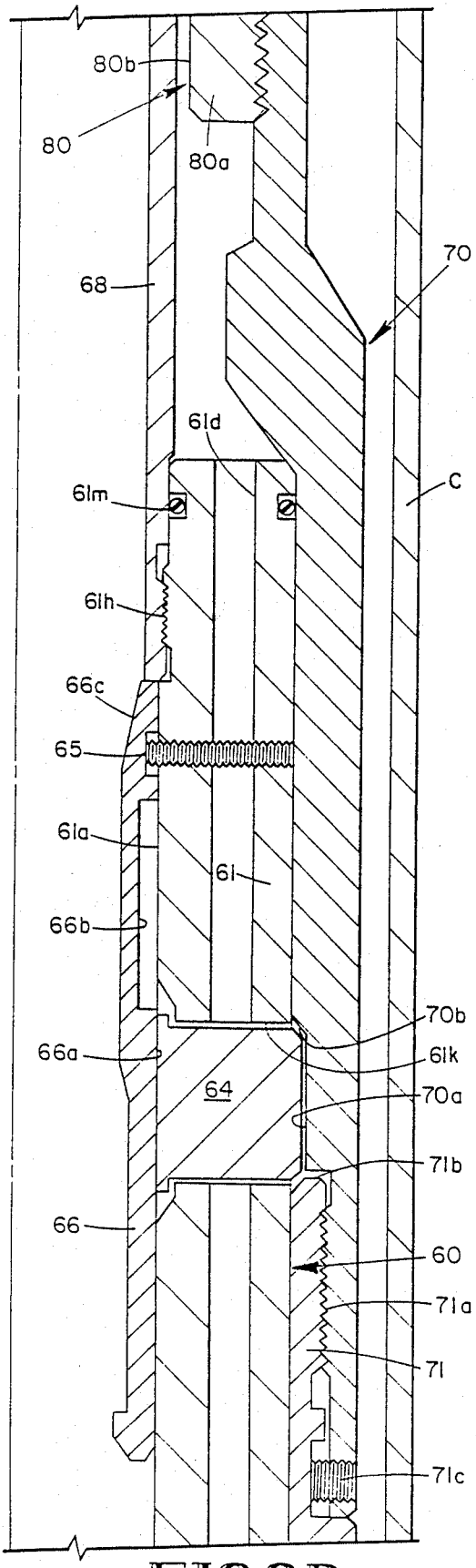
Figure 3D:
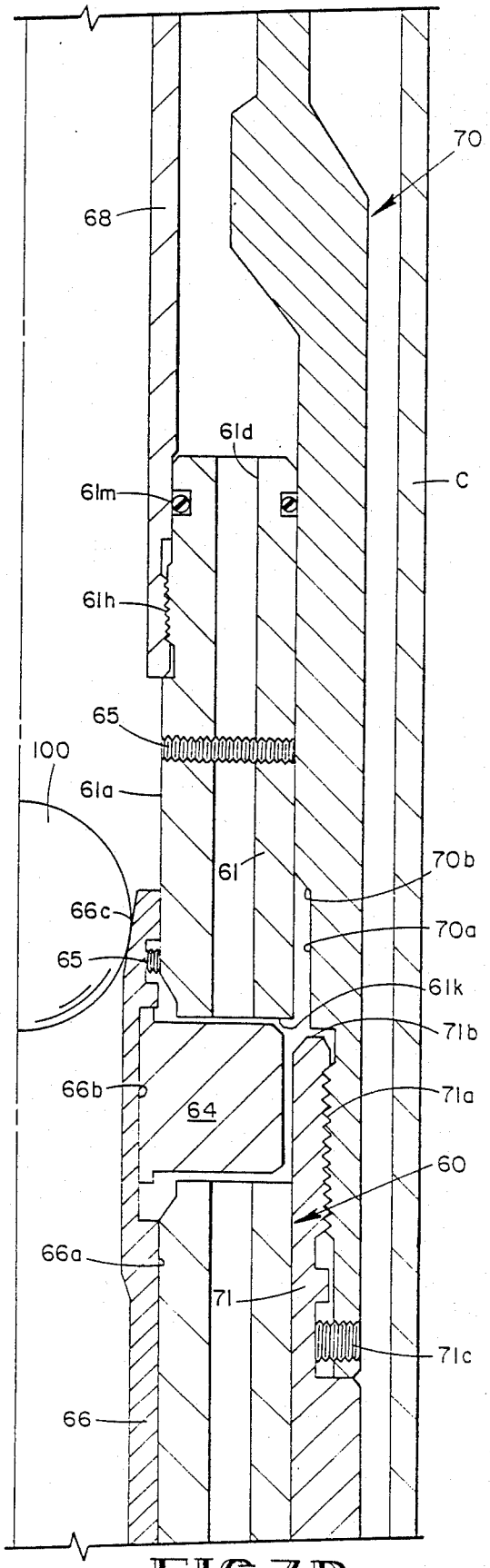
Figure 2G:
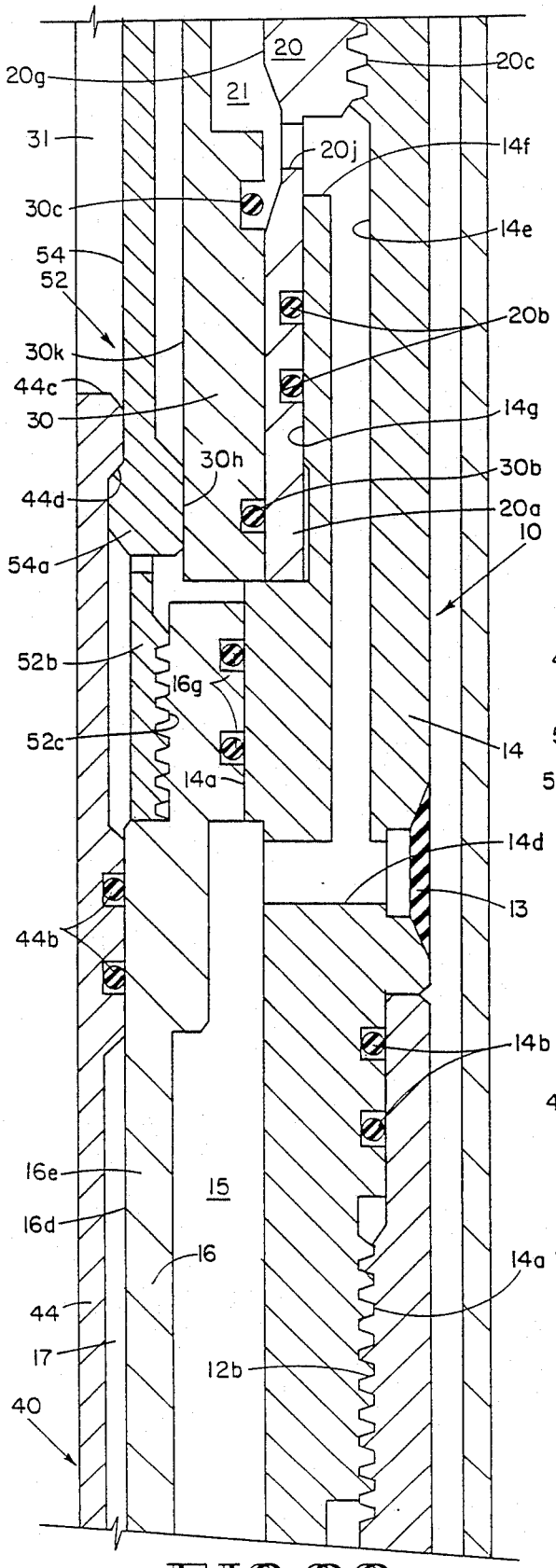
Figure 3G:
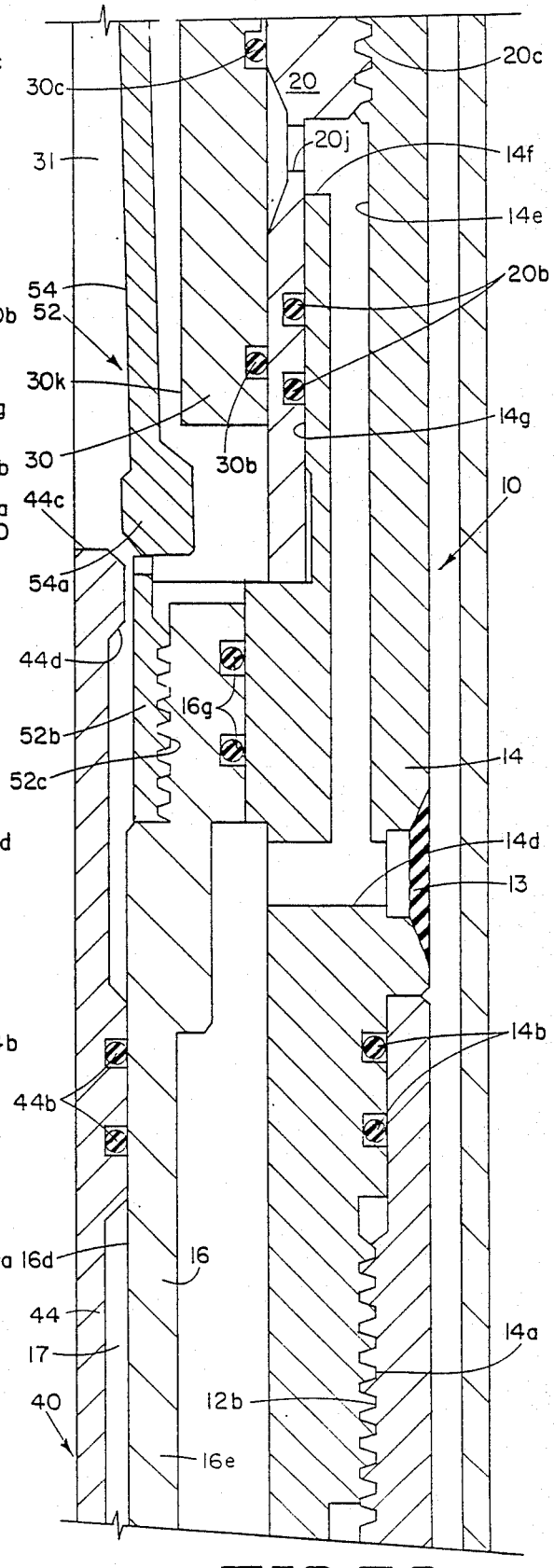
Figure 2H:
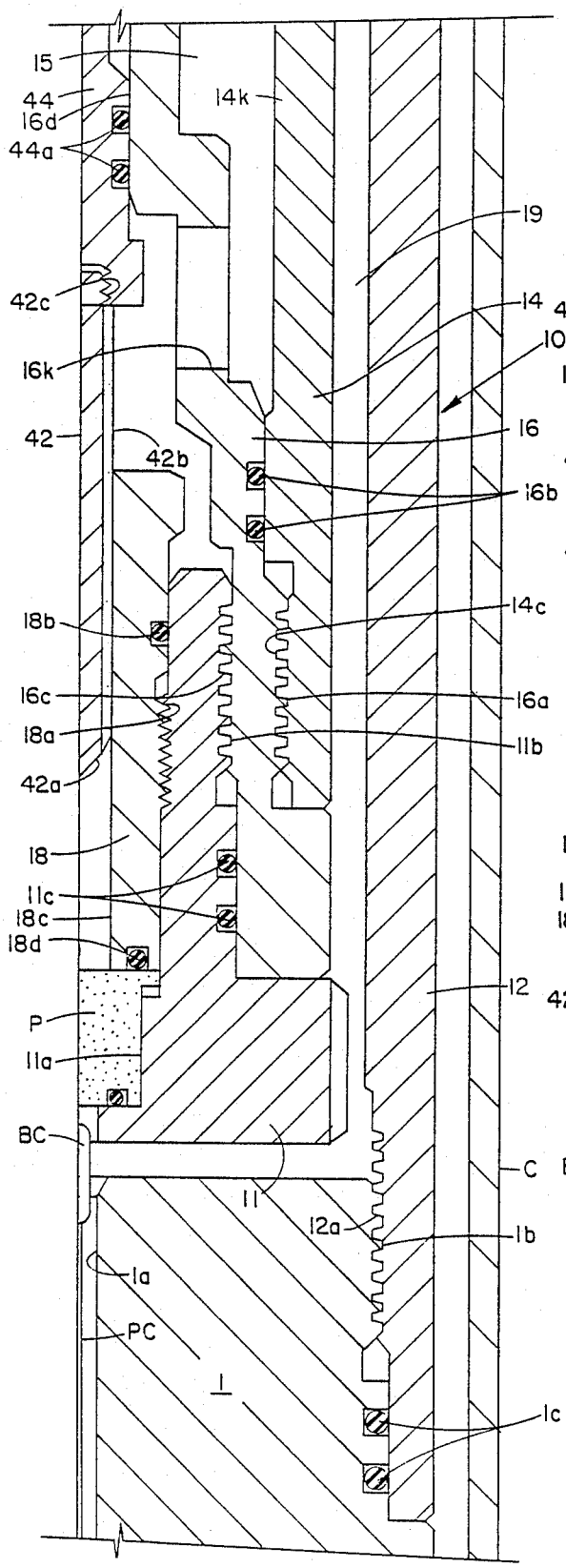
Figure 3H:
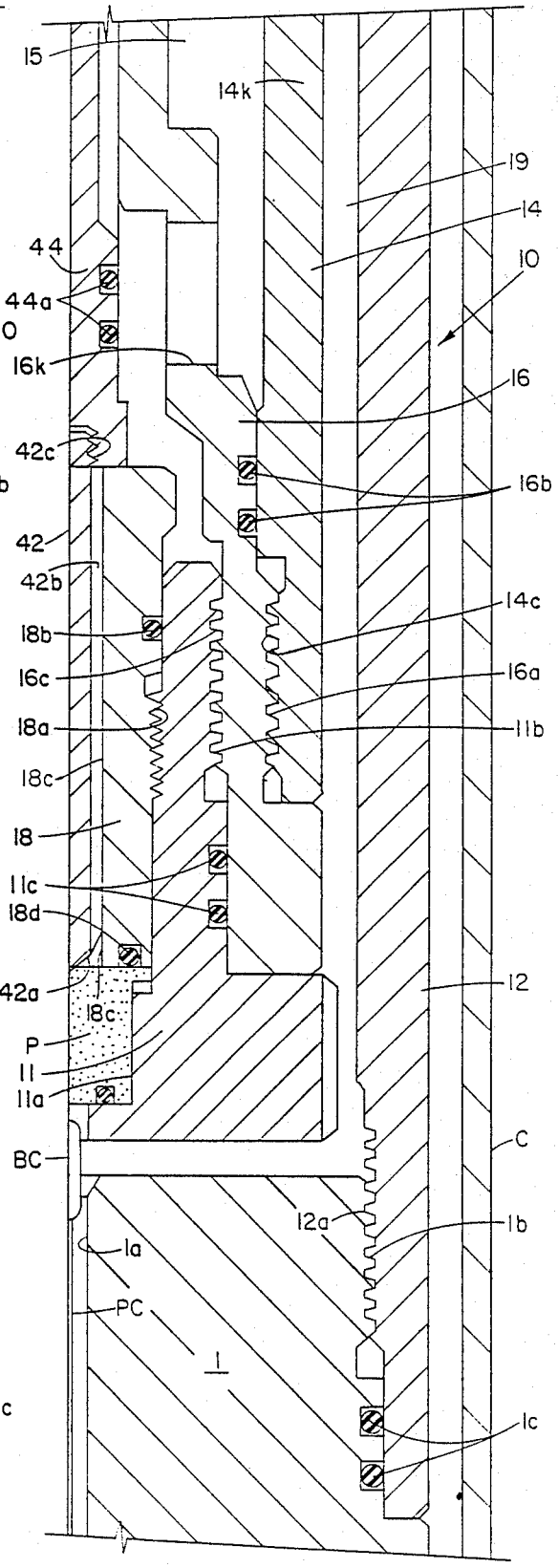

In the run-in position of the apparatus, as specifically shown in FIG. 2G, the collet-locking heads 54*a* are held in latching position with respect to the piston-type firing pin 40 by engagement with the internal surface 30*h* of the tubular piston 30. Thus, tubular piston 30 performs a dual function whenever it is moved upwardly by an increase in the annulus fluid pressure above the set packer. As illustrated in FIG. 3G, the first function is to move out of engagement with the collet-locking heads 54*a* and permit such collet-locking heads to be released whenever sufficient downward force is exerted thereon by the piston-type firing pin 40 to cam the locking heads outwardly. The second function is to close the inwardly extending radial ports 20*j* and to trap such ports between O-ring seals 30*b* and 30*c*, thus isolating the reference fluid pressure chamber 15 from all external fluid pressure sources. Obviously, the trapped pressure of the fluid contained in the reference fluid pressure chamber 15 will be the well hydrostatic pressure which will, within a few pounds per square inch, be the same as the reference fluid pressure employed in the ball valve located in the tubing string above the set packer.

From the foregoing description, it will be noted that in the run-in position of the apparatus, illustrated in FIGS. 2A–2H, the reference fluid chamber is exposed to the well hydrostatic pressure. Such well hydrostatic pressure is also applied to both the top and bottom portions of the piston-type firing pin 40 so there is no net pressure force acting on the piston-type firing pin 40 during run-in. The locking piston 30 is likewise exposed at both ends to well hydrostatic pressure and additionally, is retained in the run-in position by virtue of the shear bolts 27. When, however, the packer 80 is set by conventional manipulation of the tubing string, the annulus pressure above the packer may be increased to a substantial level, say 500 psi, above the well hydrostatic pressure. This increase in annulus pressure is transmitted to the locking piston 30, causing it to move upwardly to shear the locking bolts 27, compress spring stack 26 and close the radial ports 20*j*, thus isolating the fluid pressure in the reference fluid pressure chamber 15 from all other pressures existing in the apparatus. Thus, the reference fluid pressure, which is substantially the same as the well hydrostatic fluid pressure, is applied through port 16*k* to the bottom portions of the piston portion 44 of the piston-type firing pin 40 to urge the firing pin upwardly. Thus, the downward movement of the piston-type firing pin 40 will not be effected until the annulus pressure above the set packer is increased to a level, determined by the setting of the collet 52, that is substantially in excess of the annulus pressure required to effect the opening of the ball valve incorporated in the tubing string above the packer. Preferably, such ball valve is adjusted to open at an annulus pressure of approximately 1,000 psi and the collet 52 is adjusted to effect the release of the piston-type firing pin 40 at an annulus pressure above the set packer on the order of 1,500 psi. It is thereby assured that the firing pin 40 will not be driven downwardly into contact with the detonatable primer P until after the ball valve has been opened, thus assuring that the fluid pressure in the tubing string, and hence in the annulus below the set packer, will be substantially reduced to establish an underbalanced condition for firing of the perforating gun. It should also be noted that both the inner wall 16 and the outer wall 14 defining the fluid pressure reference chamber 15 respectively define the walls of air pressure chambers 17 and 19. Air pressure chamber 17 is defined between the seals 44*a* and 44*b* on the piston portion 42 of the piston-type firing pin 40. Air chamber 19 is defined by a reduced-diameter lower portion 14*k* of the bottom sleeve portion 14 of the housing assembly 10 and is in communication with the interior of the perforating gun by communication with the axial passage 1*a*. These air pressure chambers contain atmospheric air during assembly and are maintained at atmospheric pressure until the perforating guns fire, thus allowing well fluids to enter the guns. As a consequence of downward movement of firing pin 40, the seals 44*a* move out of sealing engagement with inner wall surface 16*d* and the reference fluid pressure chamber 15 is placed in communication with the innermost air pressure chamber 17, thus substantially reducing the fluid pressure in the reference fluid pressure chamber and hence increasing the differential pressure acting on the piston-type firing pin 40. The air chamber 19 around portion 14 and 11 always remains constant, so opening of the ball valve in the tubing string above the set packer will have no effect whatsoever on the pressure differential existing across the walls of the reference chamber 15. Thus, no significant variations in such reference pressure will be encountered as the result of placing the well in an underbalanced condition prior to detonating the firing mechanism.

A further feature of this invention lies in the provision of a detachable connection between the cross-over tool 60 and the body 80*a* of the packer 80. Thus, the upper end of the cross-over tool body 61 is detachably secured to a connecting sub 70 which has its upper end sealably and threadably secured to the lower end of the body 80*a* of the packer 80. The detachable securement is effected by a plurality of peripherally spaced locking lugs or keys 64 which are respectively mounted in a plurality of correspondingly shaped apertures 61*k* formed in the upper portion of the cross-over tool body 61. In their secured position, illustrated in FIG. 2D, the locking keys 64 project into an annular recess 70*a* defined between a downwardly facing shoulder 70*b* formed on the connecting sub 70 and an upwardly facing shoulder 71*b* formed on the upper end of a retaining sleeve 71. Retaining sleeve 71 is externally threaded at 71*a* to internal threads provided in the lower end of connecting sub 70 and the threaded connection is secured by a set screw 71*c*.

The locking keys 64 are held in the aforedescribed locking engagement with the connecting sub 70 by a shiftable sleeve 66 which is snugly but slidably mounted in the interior bore 61*a* of the cross-over tool body 61. One or more shear pin screws 65 hold the shiftable sleeve 66 in position where its outer peripheral surface 66*a* prevents radially inward movement of the locking keys 64 from the position shown in FIG. 2D.

Immediately above the locking keys 64, the shiftable sleeve 66 is provided with an annular recess 66*b* to receive the inner ends of the locking keys so when the shear pin 65 is sheared and the shiftable sleeve 66 is moved downwardly to align the recess 66*b* with the locking keys 64. Such downward movement is effected by dropping a sealable plug or ball 100 (FIG. 3D) into engagement with an upwardly facing inclined surface 66*c* formed on the upper end of the locking sleeve 66. Increasing the tubing pressure will then effect a downward force on the shiftable sleeve 66 sufficient to shear the shear pin 65 and permit the shiftable sleeve 66 to move to its unlocking position relative to the locking keys 64, as shown in FIG. 3D, thus permitting the connecting sub 70 and all of the apparatus above the connecting sub 70 to be disengaged from the cross-over tool 60 and all of the apparatus depending therefrom.

The packer 80 is of entirely conventional construction and, hence, has only been indicated schematically. Packer 80 may be set by axial or rotary motion of the tubing string by which it is suspended, or by a combination of axial and rotary motions. The packer 80 defines a central bore 80*b* extending entirely through the packer body 80*a* to provide a connection to the tubing bore connected above the packer. The cross-over tool body 61 is provided with internal threads 61*h* at its upper end and the lower end of the thin-walled snorkel tube 68 is secured to the threads 61*h* and the threaded connection is sealed by an O-ring 61*m*. Snorkel tube 68 extends entirely through the body of the packer 80 and defines an annular fluid passage 68*a* between the exterior surface of the snorkel tube and the interior bore 80*b* of the packer body 80*a*.

The upper end of the body 80*a* of the packer 80 is connected by external threads 80*c* to internal threads formed in the bottom end of a tubular port valving assemblage 90. Such assemblage comprises a lower sub 92 which provides a continuation of the annular fluid passage 68*a*. An intermediate sub 94 is threadably secured to external threads 92*a* provided on the lower sub 92 and such threaded connection is sealed by an O-ring 92*b* and secured by a set screw 92*c*. One or more radial ports 94*a* are provided in the intermediate sub 94 and these ports communicate with an annular chamber 95*a* defined by a water leg sleeve 95 which is secured by external threads 94*b* formed in the medial portion of the intermediate sub 94. An O-ring 94*c* seals this threaded connection.

The lower end of water leg sleeve 95 is inwardly enlarged as shown at 95*b* and a plurality of peripherally spaced ports 95*c* provide communication between the annular chamber 95*a* and the casing annulus. A pressure-transmitting, wiper-type nitrile seal element 96 is mounted on intermediate sub 94 in the lower end of annular chamber 95*a* to provide a pressure-transmitting seal connection to the annulus. Those skilled in the art will recognize this type of seal is effective only against small pressure differentials and any substantial increase in annulus fluid pressure will be immediately transmitted to the fluid in the annular chamber 95*a* and, hence, through the annular axial passage 68*a* to the upper chamber 31 of the fluid pressure activated firing mechanism heretofore described.

In the event it is necessary to effect the disconnection of the packer 80 from the cross-over tool 60 through utilization of the detachable connection sub 70 heretofore described, it is highly desirable that the fluid connection through the ports 94*a* be sealed off so as to prevent direct communication between the bore of the packer and the casing annulus. This permits the packer to be reset and further testing accomplished by the perforating gun inserted by wireline through the drill stem.

Accordingly, a sliding sleeve valve 96 is provided in the upper end portions of the intermediate sub 94. Valve 96 has two pairs of O-ring seals 96*a* and 96*b* respectively engaging the bore 94*d* of the intermediate sub 94 at an inactive location above radial ports 94*a*. Additionally, an O-ring seal 96*c* is provided on the interior of the sliding sleeve valve 96 in engagement with the top exterior surface 68*b* of the snorkel tube 68. The surface 68*b* is of reduced diameter relative to the remainder of the snorkel tube 68, hence defines an upwardly facing shoulder 68*c* and the sliding sleeve valve 96 is prevented from downward movement by such shoulder as long as the packer 80 remains in coupled relationship to the cross-over tool 60.

The sliding sleeve valve 96 is provided with an enlarged-diameter upper portion 96*d* within which are mounted two O-rings 96*e* which engage an internal bore surface 94*f* of the intermediate sub 94. An annular chamber 97 is thus defined which is exposed to atmospheric pressure at the well surface and retains trapped atmospheric air in such chamber during insertion of the tool into the well. The sliding sleeve valve 96 is biased downwardly by any tubing pressure existing in the tubing string, including hydrostatic pressure, but downward movement is prevented by the aforementioned upwardly facing shoulder 68*c* provided on the snorkel tube 68. When fluid pressure is applied to effect the disengagement of the disconnecting sub 70 from the cross-over tool 60, and the tubing string is moved upwardly, the stop shoulder 68*c* will therefore move downwardly relative to the sliding sleeve valve 96 and such valve is free to move downwardly under the fluid pressure bias so that seals 96*a* and 96*b* respectively overlap the radial ports 94*a* (FIG. 3A), thus effectively closing any communication with the casing annulus.

The upper end of intermediate sub 94 is internally threaded as indicated at 94g and these threads are engaged with an upper sub portion 98 of the valve closing mechanism 90. This threaded connection is sealed by an O-ring 98a and secured by a set screw 98b.

The lower end of the upper sub 98 defines a bore surface 98c along which a reduced-diameter top portion 96f of the sliding sleeve valve 96 is slidably engagable. An annular slot 96g is provided in the top portion 96f and mounts an expandable lock ring 99. When the sliding sleeve valve 96 has moved downwardly sufficient to effect the sealing off of the radial ports 94a, the expandable lock ring 99 will be positioned below the bottom end face 98d of the upper sub 98 and will prevent retraction of the sliding sleeve valve 96 to a non-sealing position relative to the ports 94a. Thus removal of the packer 80 and the other tools associated therewith in the drill string from the cross-over tool and perforating gun can be effected, without any fluid connection being established between the bore of the packer and the casing annulus.

The upper end of the upper sub 98 of the valving mechanism 90 is provided with conventional threads (not shown) for connection to the other tool elements incorporated in the drill stem testing string, as schematically illustrated in FIG. 1.

The operation of the aforedescribed apparatus will be readily apparent to those skilled in the art. The reference fluid pressure chamber 15 is filled at the well surface with a clean light density, compressible fluid, such as silicone oil. The inner and outer force equalizing chambers 17 and 19 and chamber 97 are filled with trapped atmospheric air. The entire apparatus shown in FIG. 1 is then inserted in the well and the perforating gun is positioned at a desired location with respect to a production formation for which a test is desired. The packer is then set by manipulation of the tubing string. Annulus pressure above the packer is then increased to a level of about 500 psi above the hydrostatic level, sufficient to move the dual-purpose piston 30 upwardly against the bias of the axially stacked springs 26. Such upward movement traps the hydrostatic pressure existing in the well at the position of the firing mechanism within the reference fluid pressure chamber 15. Additionally, the locking relationship of the piston 30 with the collet heads 54a is removed so that collet heads 54a can be displaced outwardly through the application of sufficient downward force to the piston-type firing pin 40.

The annulus pressure above the set packer is increased to a level of approximately 1,000 psi, at which point the ball valve incorporated in the tubing string will open. It should be noted that such ball valve opens in response to a predetermined annulus pressure above a hydrostatic reference pressure which is trapped within the valve as discussed in detail in the aforementioned U.S. Pat. No. 4,341,266. This amount of annulus pressure above the hydrostatic reference pressure is insufficient to release the collet-locking heads 54a from the piston-type firing pin 40. The opening of the ball valve establishes underbalanced conditions in the annulus below the set packer.

The annulus fluid pressure above the packer is then increased by approximately another 500 psi, and this pressure is sufficient to effect the release of the collet-locking heads 54a from the piston-type firing pin 40. Firing pin 40 is driven downwardly by the applied fluid pressure in the chamber 31. As the piston-type firing pin 40 moves downwardly, the O-rings 44a move out of sealing engagement with the surface 16d of inner wall 16 and thus puts the fluid pressure reference chamber 15 in direct communication with the atmospheric pressure chamber 17. Since the reference fluid pressure chamber was acting on the downwardly facing surfaces of the piston-type firing pin 40 to urge such firing pin upwardly, this removal of the hydrostatic pressure biasing force substantially increases the pressure differential acting on the piston-type firing pin 40 and accelerates its downward movement to impact and detonate the detonatable primer P.

It will be noted that the firing of the perforating gun is completely independent of the tubing pressure, hence any desired degree of underbalance may be obtained. Of equal importance, the perforating gun cannot be fired until after the annulus pressure above the packer has been raised to a level insuring the operation of the ball valve disposed in the tubing string, thus permitting the firing of the gun under underbalanced conditions.

During the firing procedure, the fluid pressure forces on the walls of reference pressure chamber 15 are substantially unchanged, thus avoiding mechanical expansion of the reference fluid pressure chamber to reduce the reference pressure.

If for any reason it is desirable to leave the perforating gun in the well following the firing of the gun, or the failure of the gun to fire, the drill stem testing apparatus can be separated from the cross-over tool and the depending firing mechanism and perforating gun through fluid pressure actuation of the separation sub. The act of withdrawing the separated packer and the other equipment of the cross-over tool effects the releases of a shiftable sleeve valve which closes the radial ports normally providing communication between the axially extending annular passage through the packer bore and the casing annulus above the packer.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by letters patent is:

1. Apparatus for firing a perforating gun suspended by a tubing string and a set packet at a selected location in a subterranean well, comprising, in combination: a tubular housing assembly attachable at its upper end to the set packer; a perforating gun secured to the lower end of said tubular housing assembly; a percussion detonatable primer for said perforating gun; means mounting said primer above said perforating gun and in the interior of said tubular housing assembly; said tubular housing assembly defining a first annular, axially elongated, fluid pressure chamber in the interior of said tubular housing assembly; said first fluid pressure chamber being fillable with a clean, light density, compressible fluid at the well surface; water leg means communicating between the top portion of said first fluid pressure chamber and the well annulus surrounding said tubular housing assembly, thereby imposing well hydrostatic pressure on the clean fluid in said first fluid pressure chamber; an axially extending cylinder chamber defining a bore; an axially elongated piston-free firing pin slidably and sealably mounted in the bore of said cylinder chamber; said tubular housing assembly defining a second fluid pressure chamber above said firing pin; first conduit means in said tubular housing assembly and the set packet communicating between said second fluid pressure chamber and the well annulus above the set packet, whereby increasing well annulus pressure above said set packet increases the fluid pressure in said second fluid pressure chamber and exerts a downward force on said firing pin; a normally open shiftable piston valve disposed intermediate said first fluid pressure chamber and said water leg means; a portion of said piston valve being disposed in said second fluid pressure chamber and shiftable to a closed position by a first predetermined increase in well annulus pressure above said set packet, thereby trapping a well hydrostatic reference pressure in said first fluid pressure chamber; second conduit means in said tubular housing assembly for applying said reference fluid pressure in said first fluid pressure chamber to the bottom portions of said firing pin to urge said firing pin upwardly and away from said primer; means for latching said firing pin in an elevated position relative to said primer; and means responsive to an increase in well annulus pressure above said packet to a second predetermined level above said reference pressure for releasing said latching means, whereby said firing pin is driven downwardly to detonate said primer.

2. The apparatus of claim 1 wherein said piston valve has a portion thereof locking said latching means in engagement with said firing pin until said piston valve is shiftable to said closed position.

3. The apparatus of claim 2 further comprising resilient means urging said piston valve to said normally open position.

4. The apparatus of claim 1 further comprising vertically spaced sealing means on said piston-type firing pin defining an annular atmospheric pressure fluid pressure chamber fillable at the well surface with light density, clean fluid, and port means disposed below the lowermost sealing means when said firing pin is in said elevated position to connect said atmospheric pressure chamber to said second fluid pressure chamber as said firing pin approaches said primer, thereby relieving said trapped reference fluid pressure and increasing the fluid pressure differential force on said firing pin.

5. The apparatus defined in claim 1 wherein said means for latching said firing pin comprises a downwardly facing inclined shoulder on said firing pin; a collet secured in said tubular housing assembly and surrounding said firing pin; said collet having peripherally spaced, inwardly biased latching arms engagable with said downwardly facing, inclined surface, whereby a predetermined downward force on said firing pin will cam said latching arms outwardly to release said firing pin.

6. Apparatus for firing a perforating gun suspended by a tubing string and set packer at a selected location in a subterranean well, comprising, in combination: a tubular housing assembly attachable at its upper end to the set packer; a perforating gun secured to the lower end of said tubular housing assembly; a percussion detonatable primer for said perforating gun; means mounting said primer above said perforating gun and in the interior of said tubular housing assembly; said tubular housing assembly defining a first annular, axially elongated, fluid pressure chamber in the interior of said tubular housing assembly; said first fluid pressure chamber having inner and outer walls and being fillable with a clean, light density, fluid at the well surface; water leg means communicating between the top portion of said first fluid pressure chamber and the well annulus surrounding said tubular housing assembly, thereby imposing well hydrostatic pressure on the clean fluid in said first fluid pressure chamber; a second annular, axially elongated, atmospheric air chamber surrounding said outer wall of said first fluid pressure chamber; an axially elongated, piston-type firing pin slidably and sealably mounted in the bore of said inner wall of said first fluid pressure chamber and defining a third axially elongated fluid pressure chamber adjacent said inner wall of said first fluid pressure chamber; said second and third fluid pressure chambers being fillable at the well surface with clean compressible fluid at atmospheric pressure and being isolated from contact with other fluids; said tubular housing assembly defining a fourth fluid pressure chamber above said firing pin; first conduit means in said tubular housing assembly and the set packer communicating between said fourth fluid pressure chamber and the well annulus above the set packer, whereby increasing well annulus pressure above said set packer increases the fluid pressure in said fourth fluid pressure chamber and exerts a downward force on said firing pin; a normally open, shiftable piston valve disposed intermediate said first fluid pressure chamber and said water leg means; a portion of said piston valve being disposed in said fourth fluid pressure chamber and shiftable to a closed position by a first predetermined increase in well annulus pressure above said set packer, thereby trapping a well hydrostatic reference pressure in said first fluid pressure chamber; second conduit means in said tubular housing assembly for applying said reference fluid pressure in said first fluid pressure chamber to the bottom portions of said firing pin means for latching said firing pin; in elevated position relative to said primer; and means responsive to an increase in well annulus pressure above said packer to a second predetermined level above said reference pressure for releasing said latching means, whereby said firing pin is driven downwardly to detonate said primer.

7. The apparatus of claim 6 wherein said piston valve has a portion thereof locking said latching means in engagement with said firing pin until said piston valve is shiftable to said closed position.

8. The apparatus of claim 7 further comprising resilient means urging said piston valve to said normally open position.

9. The apparatus defined in claim 6 wherein said means for latching said firing pin comprises a downwardly facing inclined shoulder on said firing pin; a collet secured in said tubular housing assembly and surrounding said firing pin; said collet having peripherally spaced, inwardly biased latching arms engagable with said downwardly facing, inclined surface, whereby a predetermined downward force on said firing pin will cam said latching arms outwardly to release said firing pin.

10. The apparatus of claim 6 wherein said firing pin has axially spaced external sealing means defining the top and bottom ends of said third fluid pressure chamber; and port means in said inner wall of said first fluid pressure chamber disposed below said elevated position and traversed by the lowermost one of said external sealing means as said firing pin moves toward said primer, thereby releasing the reference pressure from said first fluid pressure chamber.

11. Apparatus for perforating a selected formation of a subterranean well in an underbalanced condition comprising: a tubing string for lowering the apparatus into the well; a pressure-operated valve series connected in said tubing string; said pressure-operated valve being normally in a closed position relative to the tubing string bore and operable to an open position by an increase in the adjacent well annulus pressure to a first predetermined level above well hydrostatic pressure; a packer suspended by said tubing string below said pressure-operated valve; said packer being settable in the well above said selected formation; a tubular housing assembly depending from said packer; a perforating gun suspended from said tubular housing assembly and positioned adjacent said selected formation; a percussion detonatable primer for said perforating gun; means mounting said primer in above said perforating gun and the interior of said tubular housing assembly; said tubular housing assembly defining an axially extending fluid pressure chamber; a piston-type firing pin slidably and sealably mounted in said fluid pressure chamber; means for latching said firing pin in an elevated position relative to said primer; piston means for normally locking said latching means in said elevated firing pin position; said piston means being responsive to a second increase in well annulus pressure to a second predetermined level above well hydrostatic pressure to shift to an unlocking position relative to said latching means, said first predetermined level being substantially less than said second predetermined level of well annulus pressure; conduit means in said tubular housing assembly for connecting the upper portions of said axially extending fluid pressure chamber to the well annulus above said set packer, whereby a further increase in well annulus pressure above said set packer in excess of said first predetermined level releases said firing pin from said latching means to drive downwardly into impact engagement with said primer, thereby firing the perforating gun only after said pressure-operated valve has opened the bore of said tubing string.

12. The apparatus of claim 11 further comprising a cross-over tool connected intermediate said packer and said tubular housing assembly, whereby the bore of said tubing string communicates with the well annulus below said set packer upon opening of said pressure-operated valve.

13. The apparatus of claim 11 further comprising means responsive to movement of said piston means in response to said increase in annulus pressure above the set packer to said second predetermined level for trapping a well hydrostatic reference pressure in said axially extending fluid pressure chamber below said firing pin.

14. The apparatus of claim 11 further comprising resilient means biasing said piston means to said locking relationship with said latching means.

15. The apparatus defined in claim 11 wherein said means for latching said firing pin comprises a downwardly facing inclined shoulder on said firing pin; a collet secured in said tubular housing assembly and surrounding said firing pin; said collet having peripherally spaced, inwardly biased latching arms engagable with said downwardly facing, inclined surface, whereby a predetermined downward force on said firing pin will cam said latch arms outwardly to release said firing pin.

16. The method of firing a tubing-carried perforating gun supported adjacent a production formation in a subterranean well by a packer, said gun having a fluid pressure responsive firing element releasably positioned by a downward force responsive latch in a housing above a detonatable primer, and said latch being locked in engagement with said firing element by a piston, comprising the steps of:

(1) applying a reference fluid pressure to said firing element to urge said firing element upwardly, said reference pressure being derived from the well hydrostatic pressure below the packer;

(2) applying fluid pressure derived from the well annulus above said packer to urge said firing element downwardly;

(3) increasing the well annulus pressure above the packer to a first selected value to actuate a valve trapping said reference pressure acting on the firing element and to shift said piston to an unlocking position relative to said latch; and (4) increasing the well annulus pressure to a second selected value sufficient to generate a latch-releasing downward force on said firing element and drive said firing element into said detonatable primer to fire same.

17. The method of claim 16 further comprising the step of trapping said reference fluid pressure in an axially elongated annular chamber having inner and outer walls, and maintaining a constant fluid pressure adjacent the exteriors of said inner and outer walls until said firing element approaches said primer.

18. The method of claim 17 wherein said constant fluid pressure is atmospheric.

19. The method of claim 18 further comprising the step of diverting said reference fluid pressure into said atmospheric fluid pressure as said firing element approaches said primer.

20. The method of claim 16 further comprising the steps of providing communication between the bore of said tubing and the casing annulus below the packet; and reducing the fluid pressure in said tubing below the production formation pressure prior to releasing said firing element, thereby permitting firing of the perforating gun with the well zone to be perforated in an underbalanced condition.

21. The method of firing a tubing-carried perforating gun supported adjacent a production formation in a subterranean well by a packer; said gun having a fluid pressure responsive firing element releasably positioned by a downward force responsive latch above a detonatable primer, comprising the steps of:

(1) increasing the annulus pressure above the packer to a first level above the hydrostatic pressure level;

(2) in responsive to said first level of annulus pressure above the packer, trapping in a chamber a reference fluid pressure equal to the hydrostatic pressure level;

(3) applying said trapped reference fluid pressure to said fluid pressure responsive firing element to bias said firing element upwardly;

(4) applying the annulus pressure above the packer to said fluid pressure responsive firing element to bias said firing element downwardly; and (5) increasing the annulus fluid pressure above the packet to a second level sufficient to overcome the upward bias of said reference pressure and to release said latch, thereby driving said firing element downwardly to detonate said detonatable primer.

22. The method of firing a tubing-carried perforating gun supported adjacent a production formation in a subterranean well by a packet, said gun having a fluid pressure responsive firing element releasably positioned by a downward force responsive latch above detonatable primer, said latch being held in locking engagement with said firing element by a shiftable piston, said piston being shiftable in response to a differential in annulus pressure above and below the packet, comprising the steps of:

(1) increasing the annulus pressure above the packet to a first level sufficient to shift said piston, thereby releasing the locking engagement of said latch by said piston;

(2) in response to the shifting of said piston, trapping a reference fluid pressure in a chamber equal to well hydrostatic pressure;

(3) applying said trapped reference fluid pressure to said fluid pressure responsive firing element to bias said firing element upwardly;

(4) applying the annulus pressure above the packet to said fluid pressure responsive firing element to bias said firing element downwardly; and (5) increasing the annulus fluid pressure above the packer to a second level sufficient to overcome the upward bias of said reference pressure and to release said latch, thereby driving said firing element downwardly to detonate said detonatable primer.

23. The method of firing a perforating gun supported adjacent a production formation in a subterranean well by a packer, said packer communicating with a tubing string extending to the well head; said tubing string having a normally closed, pressure-operated test valve controlling fluid flow therethrough, said pressure-operated test valve being shiftable from a closed to an open position by an increase in annulus pressure above the packer to a first level above a trapped reference fluid pressure having a pressure above the hydrostatic level; said gun having a fluid pressure responsive firing element releasably positioned by a downward force responsive latch above a detonatable primer, and shiftable locking means for said latch, said locking means being shiftable out of locking engagement with said latch by an increase in annulus pressure above the packer to said reference fluid pressure level, the steps comprising:

(1increasing the annulus pressure above the packer to said reference level, thereby conditioning both said test valves and said latch for shiftable movements;

(2applying said reference level pressure to bias said firing element upwardly;

(3) applying said annulus pressure above the packer to bias said firing element downwardly;

(4) increasing said annulus pressure above the packer to said first level, thereby shifting said test valve to open position; and (5) further increasing said annulus pressure above said first level to release said firing element from said latch and drive said firing element downwardly into engagement with the detonatable primer.

24. The method of claim 23 further comprising the steps of trapping said reference level pressure in both said tester valve and said perforating gun.

25. A firing mechanism for a perforating gun suspended by tubular elements from a packet set in the casing of a subterranean well comprising a housing intermediate the perforating gun and the packet, conduit means for transmitting annulus fluid pressure above the packet to the interior of said housing; means in said housing responsive to an increase in said annulus fluid pressure for trapping a reference fluid pressure greater than the annulus hydrostatic pressure; a detonatable primer fixedly mounted in said housing; a fluid pressure shiftable firing element mounted in spaced relation to said detonatable promer; means for applying said trapped reference fluid pressure in said housing to said firing element to bias said firing element away from said detonatable primer; and means in said housing for applying said annulus fluid pressure above the packet to said firing element to bias said firing element toward said detonatable primer, whereby an increase in said annulus fluid pressure above the packer to a level above said reference fluid pressure effects the firing of the perforating gun.

26. The firing mechanism of claim 25 further comprising a latch securing said firing element in spaced relation to said detonatable primer, said latch being releasable by a predetermined force urging said firing element toward said detonatable primer.

27. The firing mechanism of claim 26 further comprising a shiftable locking piston having a normal position locking said latch in engagement with said firing element; said locking piston being shiftable from said normal position to a second position by the increase of said annulus fluid pressure to said reference fluid pressure level, thereby unlocking said latch.

28. The apparatus of claim 27 wherein the movement of said locking position to said second position effects the trapping of said reference fluid pressure in said housing.

29. Apparatus for perforating a selected formation of a subterranean well in an underbalanced condition comprising: a tubing string for lowering the apparatus into the well; a pressure-operated valve series connected in said tubing string; means in said pressure-operated valve responsive to an increase in annulus fluid pressure above the packet for trapping a reference fluid pressure level in said pressure-operated valve valve above the hydrostatic pressure; said pressure-operated valve being normally in a closed position relative to the tubing string bore and operable to an open position by an increase in the adjacent well annulus pressure to a first predetermined level above said reference pressure; a packet suspended by said tubing string below said pressure-operated valve; said packer being settable in the well above said selected formation; a tubular housing depending from said packet; a perforating gun suspended from said tubular housing and positioned adjacent said selected formation; a percussion detonatable primer for said perforating gun; means mounting said primer above said perforating gun and in the interior of said tubular housing; conduit means for transmitting annulus fluid pressure above the packer to the interior of said tubular housing; means in said tubular housing for trapping said annulus fluid pressure at said reference fluid pressure level; a fluid pressure shiftable firing element mounted in spaced relation to said detonatable primer; means for applying said trapped reference fluid pressure in said housing to said firing element to bias said firing element away from said detonatable primer; means in said housing for applying said annulus fluid pressure above the packet to said firing element to bias said firing element toward said detonatable primer, whereby an increase in said annulus fluid pressure above the packet to said first level above said reference fluid pressure opens said pressure-operated valve, and an increase in annulus fluid pressure above the packer to a second level above said first level moves said fluid pressure shiftable firing element to detonate said detonatable primer.

30. The apparatus of claim 29 further comprising; a latch securing said firing element in spaced relation to said detonatable primer, said latch being releasable by a predetermined force urging said firing element toward said detonatable primer.

31. The firing mechanism of claim 30 further comprising a shiftable locking piston having a normal position locking said latch in engagement with said latch; said locking piston being shiftable from said normal position to a second position by the increase of said annulus fluid pressure to said reference fluid pressure level, thereby unlocking said latch.

32. The apparatus of claim 31 wherein the movement of said locking piston to said second position effects the trapping of said reference fluid pressure in said tubular housing.

* * * * *